United States Patent [19]

Korhonen et al.

[11] Patent Number: 5,022,962

[45] Date of Patent: Jun. 11, 1991

[54] METHOD FOR THE TREATMENT OF SPENT LIQUORS IN PULP PRODUCTION

[75] Inventor: Olli Korhonen; Juhani Orivuori, both of Helsinki, Finland

[73] Assignee: Enso-Gutzeit Oy, Helsinki, Finland

[21] Appl. No.: 425,902

[22] Filed: Oct. 24, 1989

[30] Foreign Application Priority Data

Oct. 25, 1988 [FI] Finland ..... 884920

[51] Int. Cl.[5] ..... D21C 9/02; D21C 11/00

[52] U.S. Cl. ..... 162/29; 162/19; 162/30.1; 162/30.11; 162/37; 162/47; 162/60

[58] Field of Search ..... 162/60, 40, 37, 41, 162/47, 19, 25, 26, 28, 82, 84, 141, 142, 29, 30.1, 31, 30.11

[56] References Cited

U.S. PATENT DOCUMENTS

| | | | |
|---|---|---|---|
| 3,873,412 | 3/1975 | Charters et al. | 162/142 |
| 4,060,450 | 11/1977 | Palazzolo et al. | 162/141 |
| 4,073,678 | 2/1978 | Hammond et al. | 162/40 |

*Primary Examiner*—Peter Chin

*Attorney, Agent, or Firm*—Armstrong, Nikaido, Marmelstein, Kubovcik & Murray

[57] ABSTRACT

The invention concerns a method for the treatment of the spent liquors obtained from pulp production processes in the wood-processing industry, in which method the waste obtained from a chemical cooking process and that obtained from a mechanical process are merged for joint treatment. The chemical process may be e.g. a sulphate process and the mechanical process e.g. a chemi-thermomechanical process (CTMP), and the invention presupposes that the facilities for these processes are located close by each other, suitably within the same industrial complex. The essential feature of the invention is that the spent liquor of the CTMP is used as wash water in counter-current washing of the pulp obtained from the chemical process. The spent liquor can be used to replace part of the fresh water required for the washing of the chemical pulp, and the point at which the spent liquor is added to the process in the washing department is so chosen that the solids content of the wash water at said point has risen to essentially the same level with the solids content in the spent liquor to be fed in. The waste liquors obtained from the chemical and mechanical processes, merged as provided by the invention, are conveyed from the washing department into an evaporating plant and further to a burning station. The cooking chemicals contained in the green liquor obtained as a combustion residue are regenerated and used again.

7 Claims, 1 Drawing Sheet

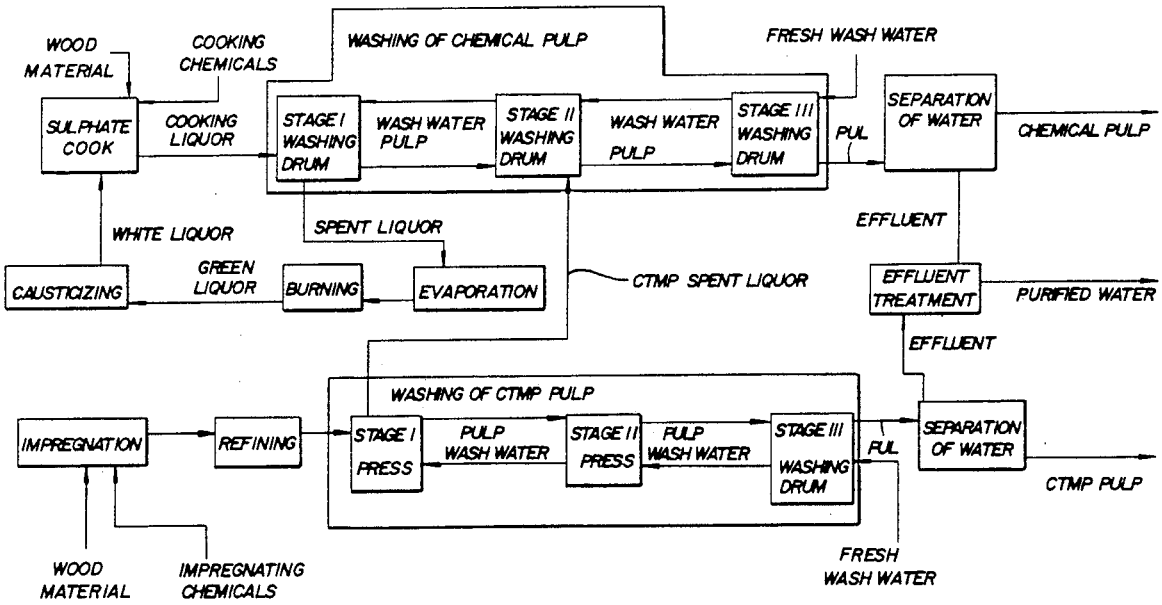

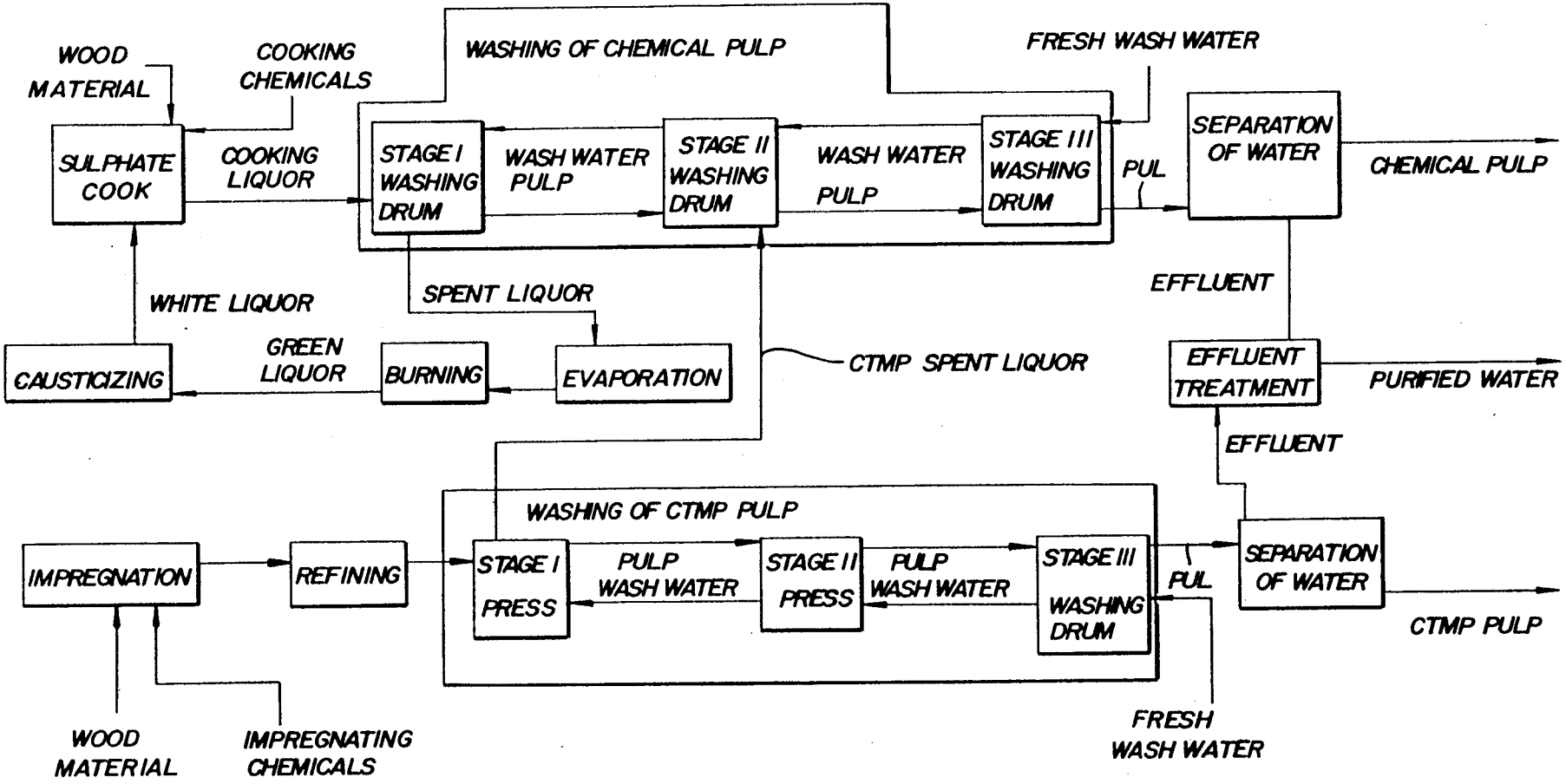
CHEMICAL PULP
PURIFIED WATER
CTMP PULP
SEPARATION OF WATER
EFFLUENT TREATMENT
EFFLUENT
EFFLUENT
SEPARATION OF WATER
FRESH WASH WATER
PUL
PUL
FRESH WASH WATER
STAGE III WASHING DRUM
STAGE III WASHING DRUM
WASH WATER
PULP
PULP WASH WATER
CTMP SPENT LIQUOR
STAGE II WASHING DRUM
STAGE II PRESS
WASHING OF CHEMICAL PULP
WASHING OF CTMP PULP
WASH WATER PULP
PULP WASH WATER
EVAPORATION
SPENT LIQUOR
STAGE I WASHING DRUM
STAGE I PRESS
BURNING
COOKING CHEMICALS
COOKING LIQUOR
GREEN LIQUOR
REFINING
IMPREGNATING CHEMICALS
WHITE LIQUOR
WOOD MATERIAL
SULPHATE COOK
CAUSTICIZING
IMPREGNATION
WOOD MATERIAL

METHOD FOR THE TREATMENT OF SPENT LIQUORS IN PULP PRODUCTION

The present invention relates to a method for the treatment of the spent liquors obtained from pulp production processes in the wood-processing industry, in which method the waste obtained from a chemical cooking process and that obtained from a mechanical process are merged for joint treatment.

A chemical cooking process, e.g. sulphate cook, produces pulp and cooking liquor. The latter contains cooking chemicals and wood-related substances, especially lignin, in a dissolved form. The pulp and cooking liquor are conveyed to a washing department, where the pulp is washed in several stages e.g. by means of washing drums arranged in series. The pulp gradually moves from one stage to the next while a flow of wash liquid is passed in the opposite direction. The wash liquid flowing out of the washing department as an effluent containing most of the solids which was present in the cooking liquor is passed to an evaporating plant and, after evaporation, to a burning station. The next stage in the sulphate process is recovery of the cooking chemicals.

In mechanical pulping processes, including various semi-chemical processes, the central operation is refining of the wood by means of a refiner. In semi-chemical processes, such as the chemi-mechanical (CMP) or the chemi-thermo-mechanical (CTMP) processes, the chips to be refined are impregnated with suitable chemicals, e.g. NaOH and $Na_2SO_3$. After the refining, the pulp is washed e.g. by a three-stage process in which presses are used in the first two stages while a washing drum is used in the third stage. In these stages, the wash water flows in a direction opposite to the direction of advance of the pulp. After the last washing stage, the wash liquid is removed as a waste liquor which contains wood-related solids and possibly impregnating chemicals, depending on the type of process involved. The waste liquor is usually passed via a chemical or a biological effluent treatment into natural watercourses.

Besides high investment and operating costs, a drawback with the effluent treatment in the wood-processing industry is that the effluents are only partially purified by the methods currently used. Moreover, biological, especially aerobic, purification processes produce large amounts of surplus biosuspension, which is difficult to treat and expensive to destroy.

The waste liquors obtained from the washing of mechanical pulp can also be subjected to evaporation instead of chemical or biological treatment. In this case, the above-mentioned problems associated with effluent treatment are avoided and, moreover, the sodium chemicals used in chemi-mechanical processes can be recovered. In cases where plants producing chemical and mechanical pulp are located close to each other, the waste liquors of the plants can also be treated in a common evaporating plant.

The present invention is based on the aforementioned idea of joint treatment of the waste obtained from chemical and mechanical pulping processes. At the background of the invention are the CTMP, which has gained ground in recent times, and the problems created by the effluents of the process in natural waters. Since the spent liquor obtained from the CTMP has a high solids content, a waste utilization solution comprising burning and chemicals regeneration is potentially advantageous even in respect of process efficiency. The only practical condition for joint treatment of the effluents as provided by the invention is that the chemical and mechanical pulp production lines be incorporated in the same industrial complex and linked to each other.

The object of the invention is to create a solution for joint treatment of the waste obtained from a chemical cooking process and a mechanical process to provide a higher treatment efficiency than is achieved by the known method of bringing the waste liquors together in a common evaporating plant. The invention is characterized in that the spent liquor obtained from a mechanical process is used as a washing liquid in counter-current washing of pulp obtained from a chemical process.

The advantage provided by the invention essentially consists in the fact that the amount of liquid passed from the washing department to the evaporating plant is smaller than it would be if the spent liquors obtained from the two processes were only merged in the evaporating plant. The reduction in the liquid quantity again directly results in a saving in the energy expenses of the plant.

According to the invention, the spent liquor of the mechanical process is used in the washing of the chemical pulp preferably along with fresh water in such manner that the spent liquor partly replaces fresh water in the total amount of water required by the washing process. In this case, the washing of the chemical pulp can be so implemented that the fresh water is supplied in a counter-current direction from that end where the washed pulp is output while the spent liquor is added to the process at a stage where the solids content of the wash water has risen to a level essentially corresponding to the solids content in the spent liquor of the mechanical process.

The washing of the chemical pulp can be implemented as a multi-stage process using e.g. washing drums arranged in series. In this case, the fresh wash water is supplied against the flow of washed pulp removed from the last drum in the series, and the spent liquor from the mechanical process can be added to the wash water between drums in such manner that the above-mentioned principle regarding the point of addition is observed as far as possible. For instance, in a counter-current washing system comprising three successive washing drums, the spent liquor from the mechanical process can generally be added at a point between the last and the last-but-one drums in the series as seen in the direction of advance of the pulp.

The basic embodiment of the invention can be regarded as consisting in linking a chemical sulphate cooking process and a CTM process in a way that enables the waste produced by the two processes to be treated in the above-defined manner, characteristic of the invention. However, other chemical cooking processes, e.g. the sulphite process, and, likewise, other mechanical pulp production processes, e.g. the chemi-mechanical process (CMP), thermomechanical process (TMP), pressure refining process (PGW) and normal refining process (GW), may be used by the method of the invention.

In the following, the invention is illustrated by the aid of an example, reference being made to the appended drawing, which shows a process diagram representing an embodiment of the process of the invention.

In the process described, chemical pulp production by the sulphate process and chemi-thermomechanical pulp production (CTMP) are linked together. The essential feature in the process is that the spent liquor obtained from the washing stage of the CTMP is passed to the chemical pulp washing department for use as wash water, in such manner that the solid components of the waste liquors of the mechanical and chemical processes are joined and end up together in a recovery treatment comprising evaporation, burning and chemicals regeneration.

In the sulphate digestion constituting the chemical process, the wood material is treated with a cooking liquor, part of whose chemicals consists of regenerated white liquor. The pulp obtained, together with the cooking liquor contained in it, is conveyed to the washing department, where the pulp is washed in three stages by means of three sucessive washing drums. Fresh wash water is supplied into the third drum, which is the last one in the series, against the outflowing pulp, from where the wash water proceeds in a counter-current direction relative to the direction of advance of the pulp, first into the second drum and then into the first drum in the series, from where it flows out as spent liquor and is subjected to burning and chemicals regeneration. The water separated from the pulp flowing out of the third drum in the series has a low solids content and is directed as an effluent to a chemical or biological purification treatment, while the chemical pulp obtained is taken to the next process stage.

In the CTM process, the wood material is in the form of chips, which are first impregnated with sodium hydroxide and sodium sulphite. After the pretreatement, the chips are refined to produce pulp, and the pulp obtained is washed. The washing is performed on the counter-current principle in three stages, presses being used in the first two stages while a washing drum is used in the third stage. The wash water is supplied against the outflowing washed pulp into the washing drum, from where it proceeds in a counter-current direction relative to the pulp flow into the presses constituting the second and first stages and is exhausted from the latter as a spent liquor containing impregnation chemicals and wood-related solids. Any water that may be separated from the washed pulp obtained from the washing drum can be directed as an effluent to a purification treatment in the same way as the water separated from the washed chemical pulp, and the CTMP pulp obtained is ready for use e.g. in the manufacture of paper and board.

As stated before, the essential feature in the process proposed is that the spent liquor obtained from the washing stage of the CTMP is passed to the washing stage of the chemical process for use as wash water in counter-current washing of the chemical pulp. As shown in the appended process diagram, the spent liquor is added to the chemical pulp wash water between the second and third washing stages in the washing department. At this point, the solids content of the chemical pulp wash water is essentially the same as that of the CTMP spent liquor to be added. Thus, the CTMP spent liquor forms part of the wash water in the second and first stages in the washing department where the chemical pulp is washed, and the solids contained in it can be utilized together with the solid waste produced by the chemical process by subjecting the spent liquor removed from the washing department first to evaporation and then to burning. The burning produces energy that can be utilized in the process, and the remaining green liquor is causticized to produce white liquor, which can be used as a cooking chemical in the sulphate cook.

It is obvious to a person skilled in the art that different embodiments of the invention are not restricted to the examples described above, but that they may instead be varied within the scope of the following claims.

I claim

1. A method for the treatment of spent liquors from wood pulp production using both a chemical process and a mechanical process selected from the group consisting of a chemical-mechanical process and a chemi-thermo-mechanical process, said method comprising introducing fresh wash water into a last pulp washing stage of a mechanical process line, advancing said wash water countercurrent to said pulp direction, transferring said wash water from a first washing stage of said mechanical process to a washing stage of said chemical process, withdrawing said wash water as spent liquor from a first washing stage of said chemical process line and treating said spent liquor by evaporation and burning.

2. A method according to claim 1, wherein said wash water transferred from said mechanical process into said chemical process is mixed with fresh wash water separately introduced into said chemical process.

3. A method according to claim 2, wherein said wash water transferred from said mechanical process into said chemical process is mixed with separately introduced fresh wash water at an intermediate washing stage of said chemical process.

4. A process according to claim 3, wherein the intermediate washing stage is one wherein the transferred wash water from said mechanical process and the wash water introduced as fresh water at a later stage of said chemical process have substantially the same solids content when they are combined.

5. A method according to claim 1, wherein said chemical process is a sulphate process.

6. A method according to claim 1, wherein said mechanical process is a chemi-mechanical process.

7. A method according to claim 1, wherein said mechanical process is a chemi-thermo-mechanical process.

* * * * *